US007036642B2

(12) United States Patent
Hoberman et al.

(10) Patent No.: US 7,036,642 B2
(45) Date of Patent: May 2, 2006

(54) LAPTOP COMPUTER CARRYING CASE

(75) Inventors: Barry Hoberman, Coral Springs, FL (US); Jacqueline N. Miller, Boca Raton, FL (US)

(73) Assignee: Travelpro International, Inc., Boca Raton, FL (US)

( * ) Notice: Subject to any disclaimer, the term of this patent is extended or adjusted under 35 U.S.C. 154(b) by 148 days.

(21) Appl. No.: 10/766,732

(22) Filed: Jan. 28, 2004

(65) Prior Publication Data

US 2005/0161301 A1 Jul. 28, 2005

(51) Int. Cl.
*A45C 13/30* (2006.01)
*A45C 13/10* (2006.01)
*A45C 3/02* (2006.01)

(52) U.S. Cl. ..... 190/36; 190/109; 190/902; 206/320; 206/576

(58) Field of Classification Search ..... 190/27, 190/36, 102, 109, 902, 39, 110; 206/320, 206/576; 383/98, 99
See application file for complete search history.

(56) References Cited

U.S. PATENT DOCUMENTS 296,993 A * 4/1884 Moffly ..... 206/454
1,639,418 A * 8/1927 Washburn ..... 220/592.14
1,702,905 A 12/1929 Korchmar
1,895,278 A * 1/1933 Crawford ..... 383/96
2,343,260 A * 3/1944 Leader et al. ..... 5/499
D292,746 S 11/1987 Allen
4,800,629 A 1/1989 Ikeda
4,802,233 A * 1/1989 Skamser ..... 383/15
5,160,001 A 11/1992 Marceau
5,217,119 A * 6/1993 Hollingsworth ..... 206/583
5,494,157 A * 2/1996 Golenz et al. ..... 206/320
5,524,754 A * 6/1996 Hollingsworth ..... 206/320

(Continued)

FOREIGN PATENT DOCUMENTS

DE 29611563 U1 * 9/1996
GB 2 333 033 7/1999
JP 10166165 12/1999
JP 11018591 8/2000

(Continued)

*Primary Examiner*—Sue A. Weaver
(74) *Attorney, Agent, or Firm*—Sacco & Associates, PA

(57) ABSTRACT

Laptop computer carrying case of a generally parallelepiped form for transporting laptop computers of small and oversized dimensions. The carrying/case includes a front panel, a rear panel spaced apart and opposed from the front panel and a pair of side panels attached to the front and rear panels along corresponding side edges of the front and rear panels. A base panel is attached to the front, rear and side panels. A cover flap is attached to the case and is adjustably latched to the case. One or more side straps protect oversized computers from damage.

31 Claims, 8 Drawing Sheets

U.S. PATENT DOCUMENTS

| | | | | |
|---|---|---|---|---|
| 5,607,054 | A | 3/1997 | Hollingsworth | |
| 5,622,262 | A * | 4/1997 | Sadow | 206/522 |
| 5,676,223 | A * | 10/1997 | Cunningham | 190/109 |
| 5,725,090 | A * | 3/1998 | Vermillion et al. | 206/320 |
| 5,762,170 | A * | 6/1998 | Shyr et al. | 190/109 |
| 5,887,777 | A | 3/1999 | Myles et al. | |
| 5,960,952 | A | 10/1999 | Chen | |
| 6,145,661 | A * | 11/2000 | Jung | 206/320 |
| 6,237,766 | B1 * | 5/2001 | Hollingsworth | 206/320 |
| 6,334,533 | B1 * | 1/2002 | Hollingsworth et al. | 206/320 |
| 6,367,839 | B1 * | 4/2002 | Langhoff | 280/751 |
| 6,390,297 | B1 * | 5/2002 | Hollingsworth | 206/320 |
| 6,446,688 | B1 | 9/2002 | Sutton | |
| 2002/0017011 | A1 | 2/2002 | Kawamura | |
| 2003/0226730 | A1 * | 12/2003 | Platte, III | 190/103 |

FOREIGN PATENT DOCUMENTS

| | | |
|---|---|---|
| WO | WO/93/24028 | 12/1993 |
| WO | WO 01/76405 | 10/2001 |

* cited by examiner

LAPTOP COMPUTER CARRYING CASE

BACKGROUND OF THE INVENTION

1. Statement of the Technical Field

The inventive arrangements relate generally to methods and apparatus for laptop computer carrying cases.

2. Description of the Related Art

With the increase in popularity of laptop computers, there has arisen a corresponding need for suitable carrying cases to protect such devices in transit. A wide variety of such carrying cases are available. For example, U.S. Pat. No. 5,160,001 to Marceau discloses a computer currying case that includes a pair of laterally spaced straps for suspending a laptop computer from a central dividing wall within the case. Similarly, International Publication number WO 93/24028 to Hollingsworth discloses a laptop computer carrying case that includes an elastic sling suspension system to help protect a laptop computer from shocks and impacts when the case is placed on the floor. Yet another laptop computer carrying case is disclosed in U.S. Pat. No. 5,887,777 to Myles et al. The Myles at al. reference includes a carrying strap which is capable of being secured in a first arrangement for carrying the bag in a substantially vertical orientation and in a second arrangement for carrying the bag in a substantially horizontal arrangement such that the computer can be operated through the opening in the front wall while being carried in the substantially horizontal orientation.

Although laptop computer carrying cases are offered in a wide variety of sizes and with a variety of features, one persistent problem concerns variety of different sizes in which laptop computers are manufactured. The many different sizes necessitate a custom designed carrying case for every different size laptop computer in order to facilitate a snug fit. While it is certainly possible for manufacturers to design and produce such a wide variety of cases, it is costly to design, develop, manufacture and maintain inventory of such a wide variety of different cases. The problem is exacerbated at the retail sale level because many retailers offer more than one brand of laptop computer for sale. This increases the number of laptop cases they must stock at any given time.

Yet another problem with existing laptop cases arises at the consumer lever. Because technology advances so rapidly, many laptop computers can become obsolete while the laptop case is still in relatively new condition. When the consumer purchases a new computer, the old case often will not fit because the new laptop computer is either smaller or larger in dimensions.

SUMMARY OF THE INVENTION

The invention concerns a laptop computer carrying case of a generally parallelepiped form. The carrying case includes a front panel, a rear panel spaced apart and opposed from the front panel and a pair of side panels attached to the front and rear panels along corresponding side edges of the front and rear panels. A base panel is attached to the front, rear and side panels along a base edge defined respectively on each of the front rear and side panels.

A cover flap can be attached to the carrying case and can extend across an opening defined by the front, rear and side panels. The cover flap can have a certain degree of overlap with the front panel when secured in a latched position. A latch point positioner can also be provided. The latch point positioner can be adapted for selectively controlling a slack in the cover flap, such that the slack at least partially encloses an auxiliary carrying case volume exclusive of a main volume defined by the front, rear, base and side panels.

At least one strap can extend from each of the side panels and substantially cover a gap area between the side panel and the cover flap. Each of the straps can be advantageously attached at a proximal end to each of the side panels, and can have a latching structure disposed at a distal end thereof for releasably securing the distal ends to each other. Further, the straps can include a length adjustable section permitting the strap to be adjusted from at least a first length to a second length. The first length can be approximately 50% of the distance between the side panels whereas the second length can be between about 60% and 90% of the distance between the side panels.

According to one embodiment, at least a portion of each strap can include an elastic material and a second portion of the strap can include a resilient pad material that can be disposed within a protective outer fabric layer. The resilient pad material can cover at least a gap area between the side panel and the cover flap that is created by the slack.

DETAILED DESCRIPTION OF THE PREFERRED EMBODIMENTS

Figure 1:
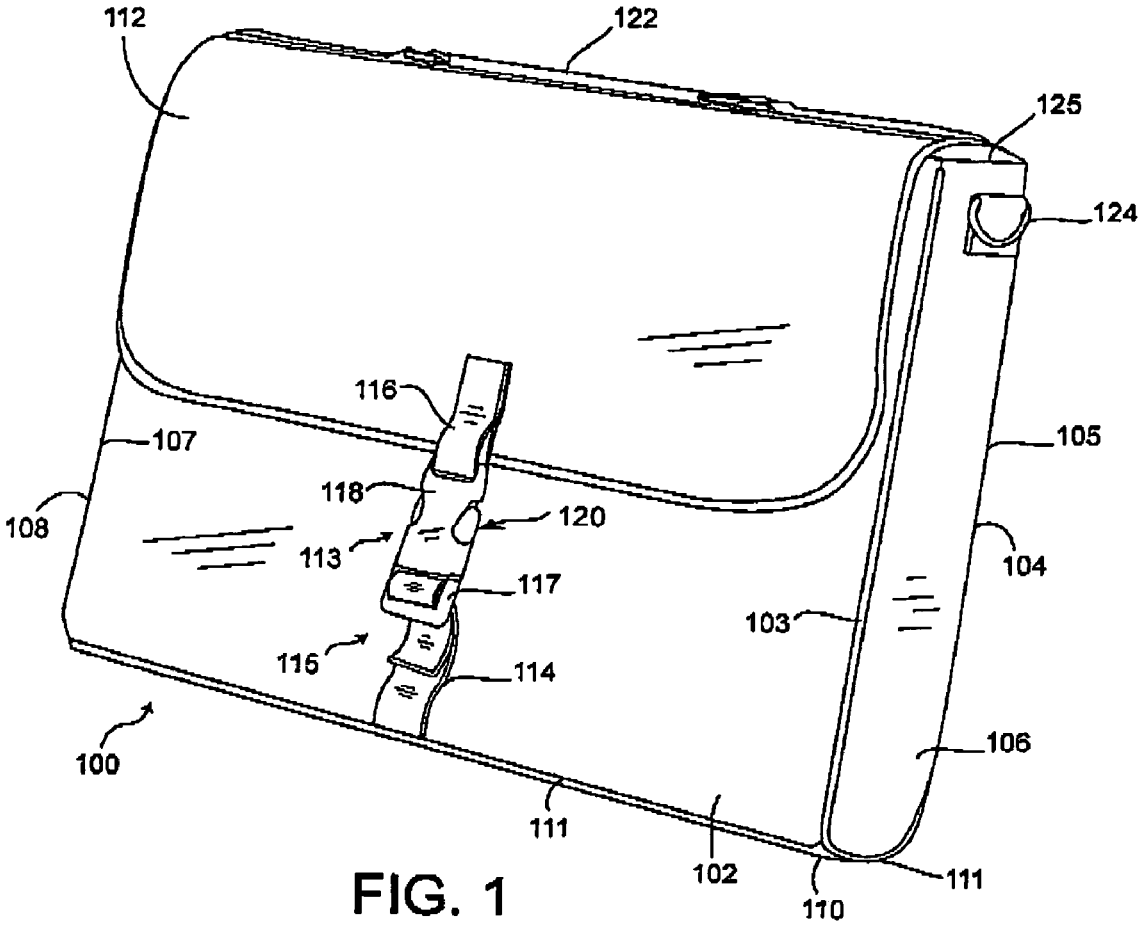
FIG. 1 is a perspective view of a laptop computer carrying case that is useful for understanding the inventive arrangements.

The invention concerns a laptop computer carrying case that can accommodate a wide variety of laptop computers of varying sizes. Referring now to FIGS. 1–7, a laptop computer carrying case is illustrated that is useful for understanding the inventive arrangements. The laptop computer carrying case 100 can have a generally parallelepiped form that is defined by a front panel 102, a rear panel 104 spaced apart and opposed from the front panel, and a pair of side panels 106, 108 . The side panels are attached to the front and rear panels along corresponding side edges 103, 105 and 107, 109 of the front and rear panels. A base panel 110 is attached to the front, rear and side panels along a base edge 111 defined respectively on each of the front, rear and side panels. The front, rear, side and base panels define a main volume of the carrying case.

A cover flap 112 is also provided for the carrying case. The cover flap 112 can extend across an opening 138 defined by the front panel 102, rear panel 104 and side panels 106, 109. A portion of the cover flap 112 can overlap with a portion of the front panel 102 when the cover flap is secured in a latched position as shown in FIG. 1. A carrying handle 122 can be provided in addition to suitable links 124 for receiving a shoulder strap, not shown.

Figure 4:
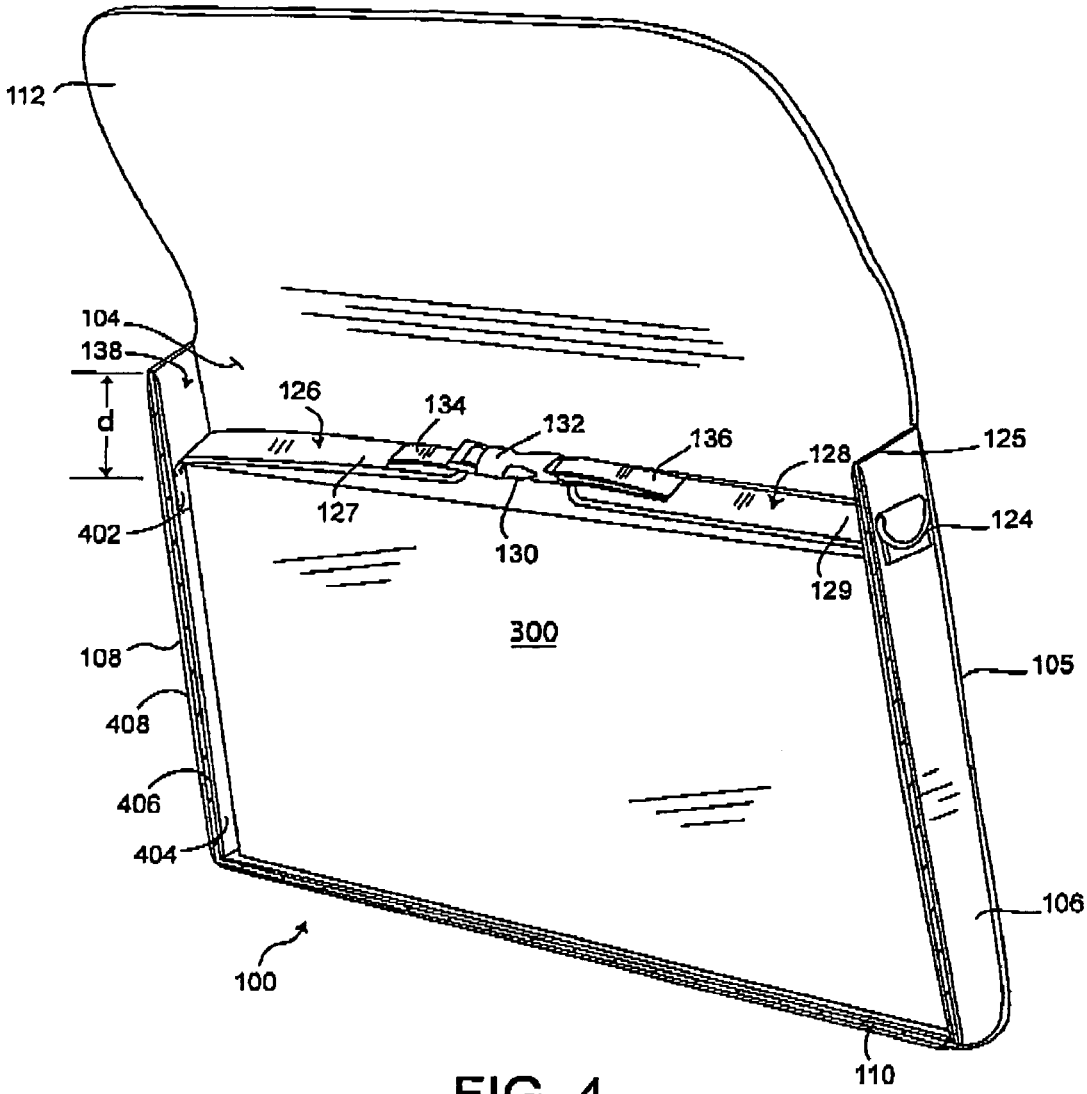
FIG. 4 is perspective view of the laptop computer carrying case in FIG. 3 with a front panel of the case shown cut away along line 4—4 to more completely illustrate the manner in which the laptop computer can be secured therein.

The front, rear, side and base panels of the laptop computer carrying case can be formed from a double wall construction that includes outer fabric layers enclosing a sheet of resilient material. FIG. 4 illustrates the double wall construction that can be used for the side panels 106, 108, and base panel 110. The double wall construction can include outer fabric layers 404, 408 enclosing a resilient layer 406.

The resilient material can add structural stiffness to the carrying case. The resilient material also advantageously serves to cushion any laptop placed in the bag against impacts. The cover flap can have a similar construction to that described herein with regard to the panels. Of course, those skilled in the art will readily appreciate that the panel construction described herein is merely one possible way in which the panels and cover flap can be constructed. There are many other alternative constructions that are well known in the art, and the invention is not limited to any particular one. For example the panels and cover flap can be formed of fabric, leather, imitation leather products, padded leather, neoprene or any other suitable material.

A latch point positioner can be provided for securing the flap to the luggage case 100. The latch point positioner can be any structure capable of adjusting the point at which the cover flap 112 is latched to the laptop carrying case. For example, a latch point positioner 115 can be comprised of a strap 114 and a buckle 113 disposed on the front panel 102 of the laptop carrying case 100. The strap can be formed of leather, plastic, fiber webbing, or any other suitable material.

The buckle 113 can include a slide bar 117 around which the strap 114 is disposed so that the buckle can be repositioned and then secured along the length of the strap. In this way, the position of the buckle can be easily adjusted relative to base edge 111. The buckle 113 can be formed from a male portion 120 having resilient arms 121 for releasably engaging a female portion 118 that is attached to the cover flap 112 by means of a second strap 116. Buckles with slide bars and resilient arms of this type are well known in the art. The buckle can be formed of metal, plastic or any other suitable material.

Those skilled in the art will readily appreciate that the invention is not limited to the latch point positioner shown in FIGS. 1–7. Instead, any manner of latch point positioning system can be used provided that it performs the functions described herein. For example, instead of using a buckle and strap arrangement, hook and loop fasteners 204 can be attached to some portion of the cover flap 112 for engaging a corresponding hook and loop fastener 202 that is attached to some portion of the case, such as the front panel.

Figure 2:
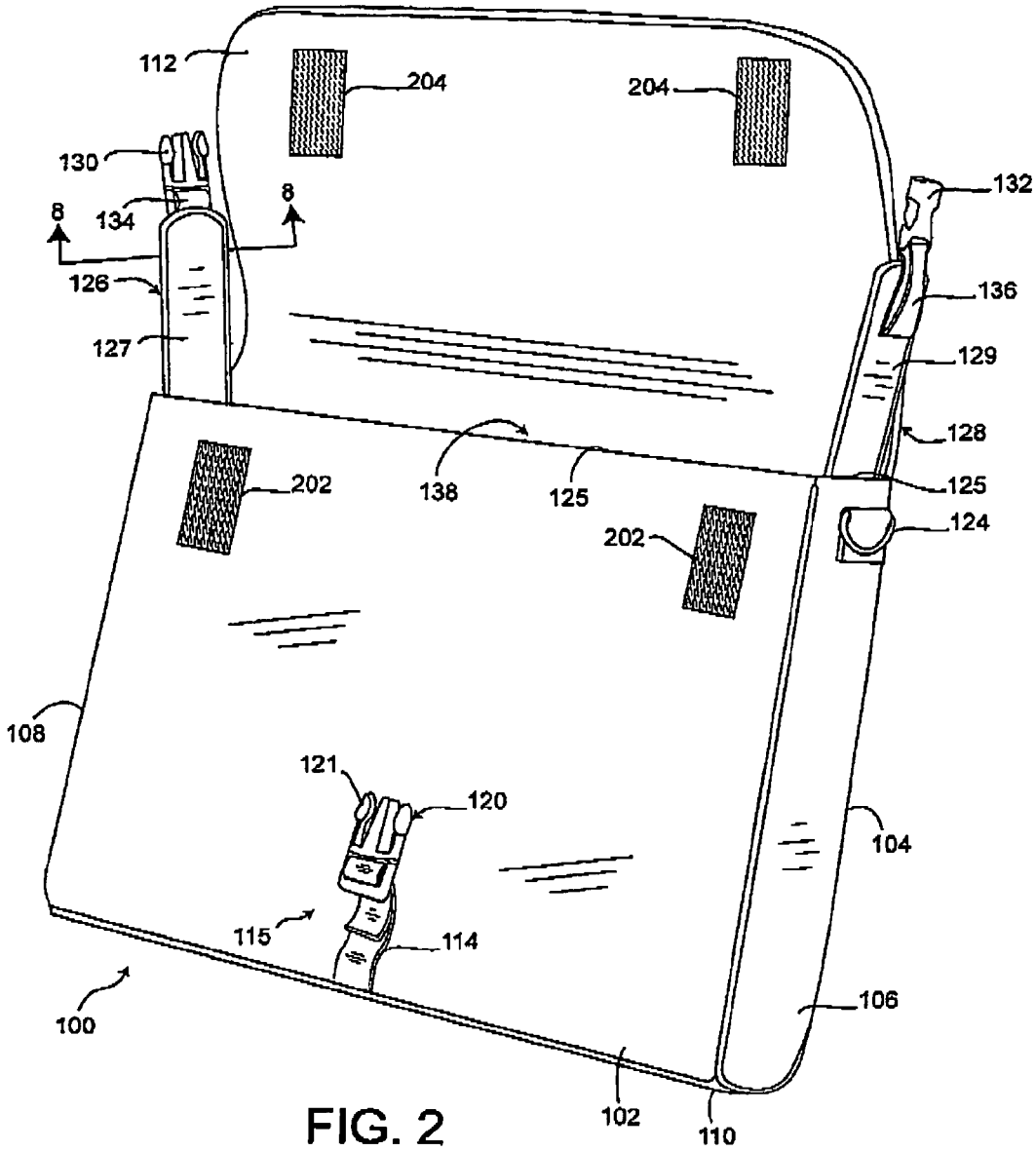
FIG. 2 is a perspective view of the laptop computer carrying case in FIG. 1 with a cover flap in an open position and showing a set of adjustable straps.
Figure 3:
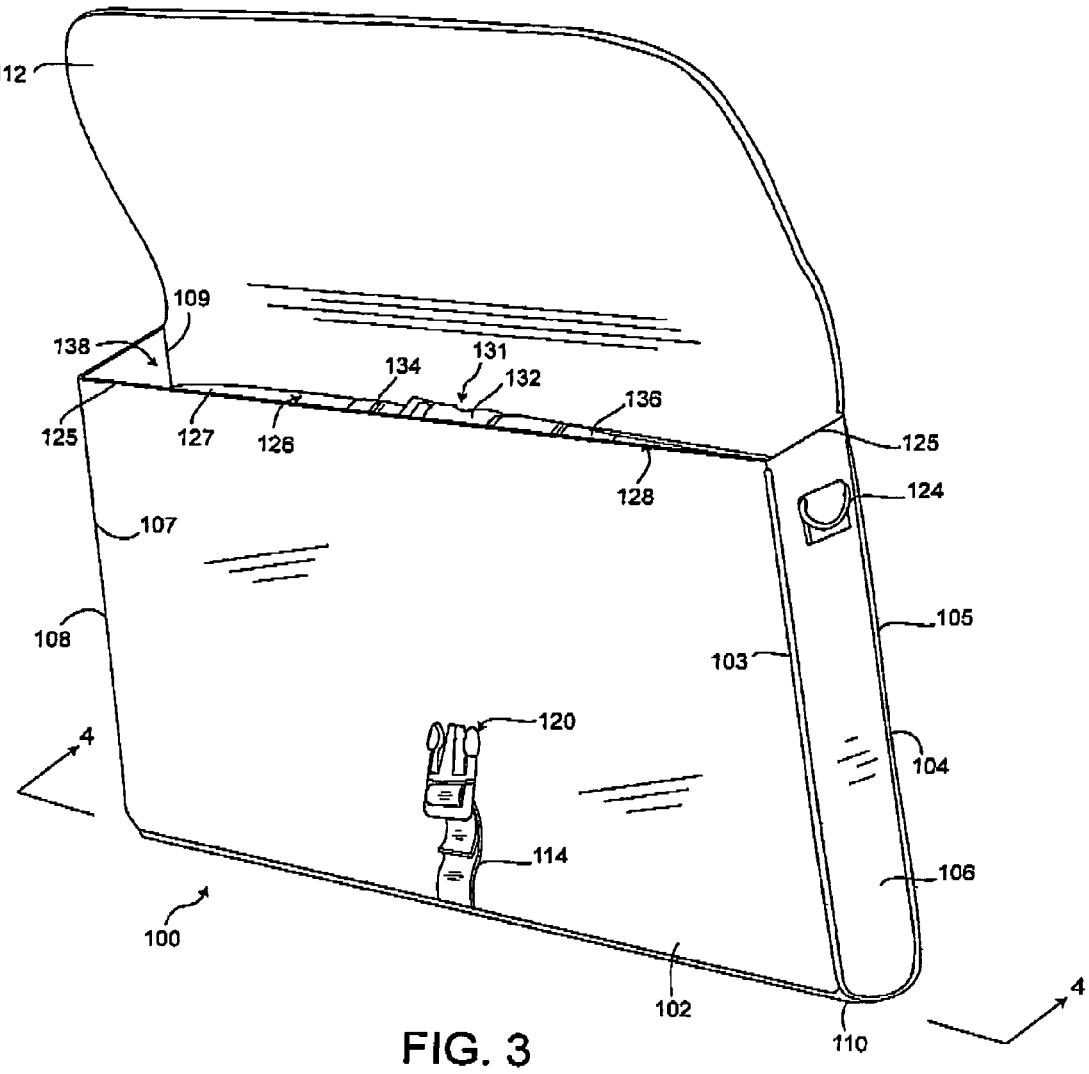
FIG. 3 is a perspective view of the laptop computer carrying case in FIG. 2 with a laptop computer secured therein by means of the adjustable straps.

In FIGS. 1–4 a laptop computer 300 is shown disposed within the carrying case 100. As shown in FIGS. 3 and 4, the laptop computer 300 is entirely contained within the limits of the case defined by front panel 102, rear panel 104 and side panels 106, 108. Notably the laptop computer does not extend above the limits of an edge 125 defined on an upper extremity of the front, rear and side panels. However, the laptop computer is retained securely within the case by straps 126, 128. This is accomplished by the advantageous positioning of the attachment point for straps 126, 128 a distance "d" below the upper edge. For example, if the distance "d" is about 3" below the edge 125, this case will be able to accommodate a wide range of laptop computers.

Figure 5:
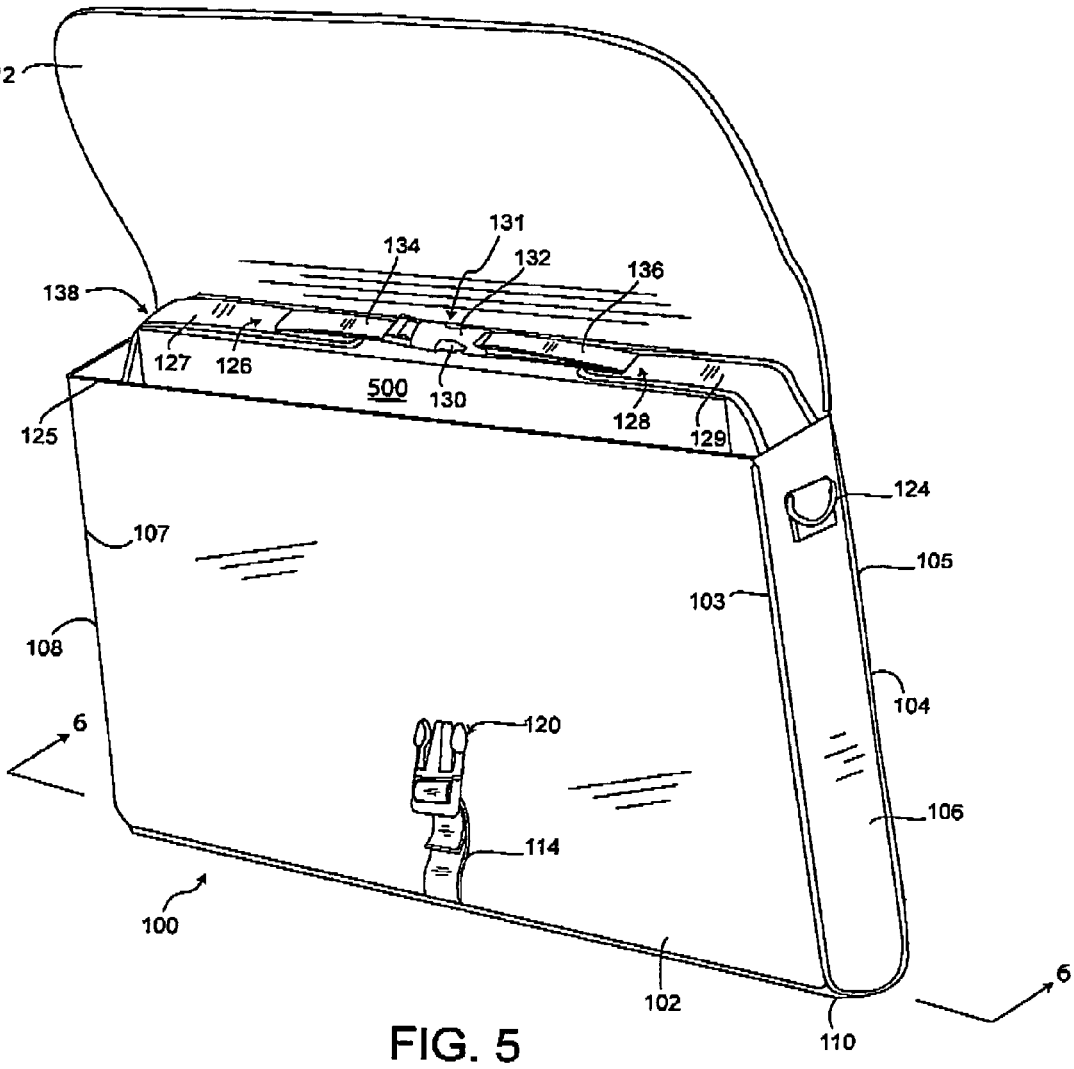
FIG. 5 is a perspective view of the laptop computer in FIG. 1 with an oversized laptop computer stored therein.
Figure 6:
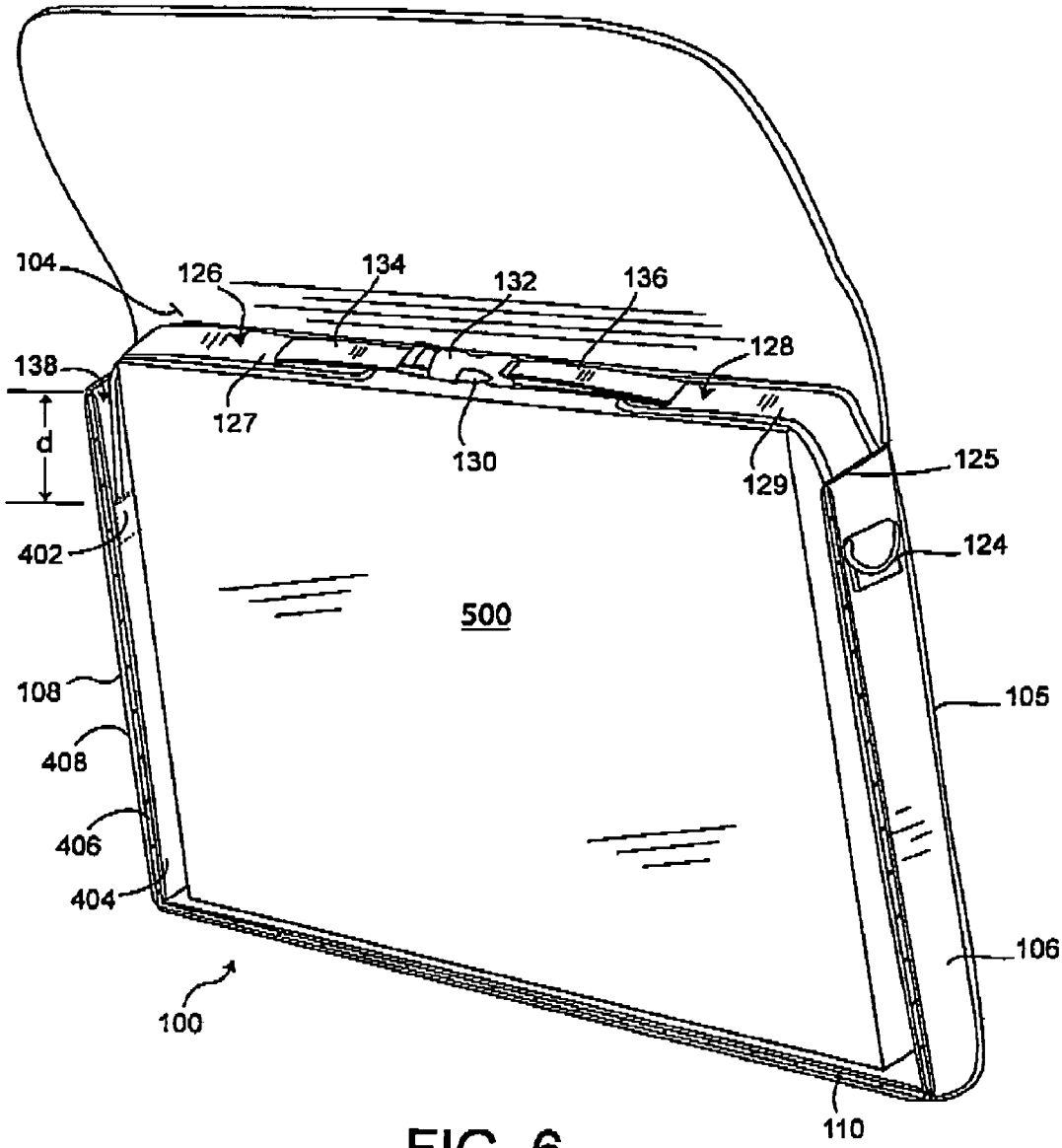
FIG. 6 is perspective view of the laptop computer carrying case in FIG. 5 with a front panel of the case shown cut away along line 6—6 to more completely illustrate the manner in which the laptop computer can be secured therein.
Figure 7:
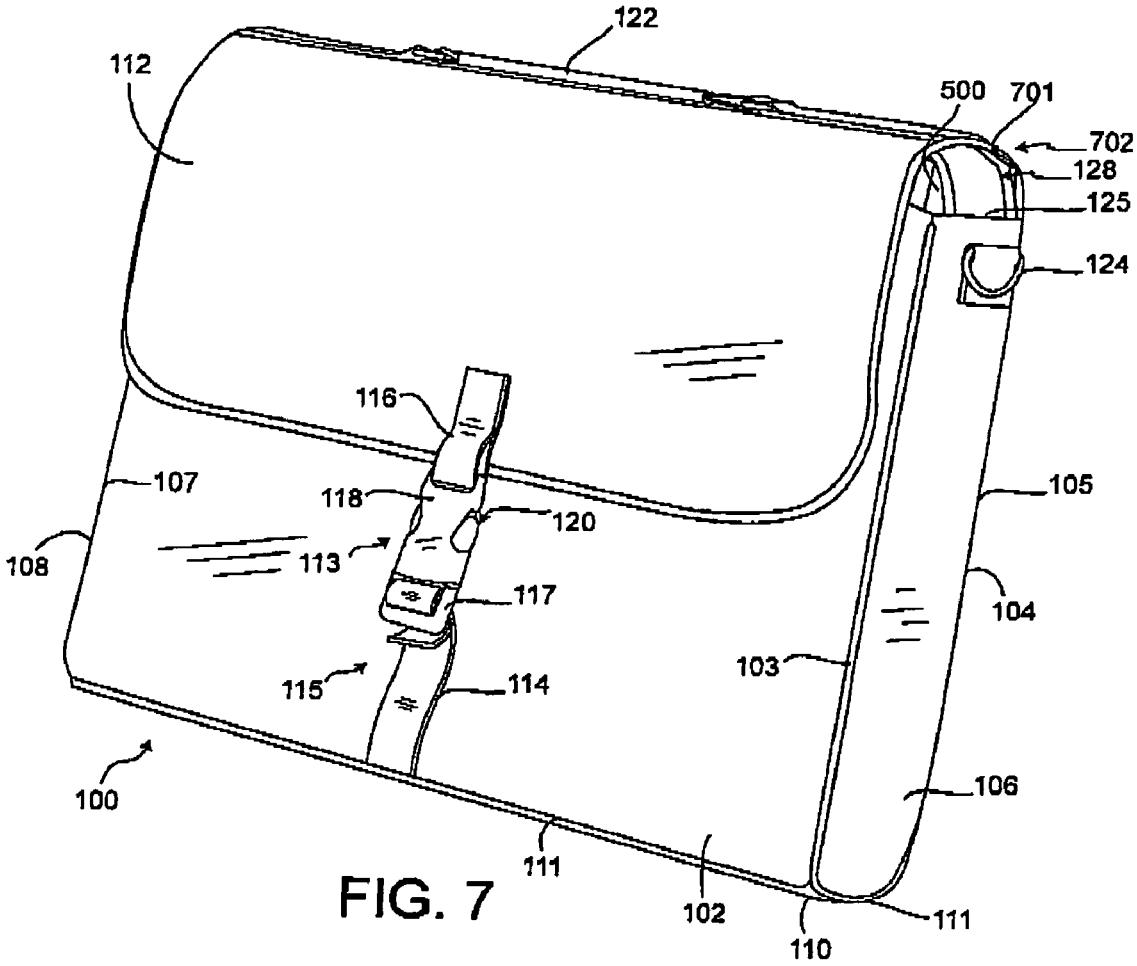
FIG. 7 is a perspective view of the laptop computer carrying case in FIG. 5 with the cover flap in a closed position.

According to a preferred embodiment, the laptop computer carrying case is adapted for also carrying an oversized laptop computer 500 as shown in FIGS. 5–7. The latch point positioning system shown in FIGS. 1–7 can advantageously adjust the position of the cover flap 112 relative to the opening 138 formed by the front panel 102, rear panel 104, and side panels 106, 108. The latch point positioning system can be used to adjust the cover flap so that it snugly traverses the opening 138 with little or no gap between the upper edge of the case 125 and the cover flap 112. Alternatively, by adjusting the latch point positioning system to move the latch point closer to the upper edge 125 of the case, a certain amount of slack 701 can be introduced into the cover flap 112 so that it no longer snugly traverses the opening 138. This is illustrated in FIG. 7, which shows that a gap 702 can be formed when the slide bar 117 is adjusted away from the base edge 111. The slack formed in the cover flap can be useful for provide auxiliary carrying case volume (in addition to the main volume defined by the front, rear, side and base panels). The auxiliary carrying case volume is advantageous for accommodating oversized laptop computers.

Still, the gap 702 that is created when an oversized laptop computer is disposed within the carrying case 100 can create a problem to the extent that it can leave exposed a portion of a oversized laptop computer 500 disposed therein. This is undesirable because a portion of the laptop computer can be exposed to mechanical shocks and impacts, as well as adverse environmental conditions such as rain. In order to protect those portions of the oversized laptop computer 500 that would otherwise be exposed by gap 702, one or more protective elements can be provided.

In particular, straps 126, 128 can extend from each of the side panels 106, 108. According to one embodiment, the straps 126, 128 can advantageously be selected to have a width and length that will substantially cover any portion of an oversized laptop computer 500 that is exposed by the gap 702 defined between the side panel 106, 108 and the cover flap 112. The straps 126, 128 can be attached at a proximal end to each of the side panels 106, 108 respectively.

Referring now to FIGS. 4 and 6 it can be observed that the straps 126, 128 are shown attached along an interior wall at an attachment point 402. The exact location of the attachment point 402 relative to the sidewalls is not critical. However, placement of the attachment point too high can prevent the straps 126, 128 from engaging smaller laptop computers, thereby allowing them to move about within the case and exposing them to potential damage. Accordingly, for the purpose of accommodating smaller sized laptop computers, the attachment point 402 is advantageously positioned a distance "d" below edge 125 defined on an upper extremity of the front, rear and side panels. This positioning ensures that the straps 126, 128 will snugly engage laptop computers that have dimensions that are smaller than the overall size of the case. For example, distance "d" can be selected so as to be at least about 1" below edge 125. Distance "d" can include as much as the entire distance between the edge 125 and the the base panel 110. According to a preferred embodiment, the attachment point can be between one to four inches below the edge 125.

According to another embodiment, now shown, the straps 126, 128 can be attached to the front panel 102, or rear panel 104, or even the base panel 110, provided that the strap extends across the area associated with gap 702 as described herein.

The straps 126, 128 can have a latching structure disposed at a distal end thereof for releasably securing together the distal end of one strap 126 to the distal end of the other strap 128. The latching structure can include any arrangement capable of securing the distal ends of the straps. For example the latching structure can be comprised of a buckle 131 that includes a male portion 130 and a female portion 132. In FIG. 1–3, the buckle 131 has a pair of resilient arms formed as part of the male portion 130 that interlock with a slot formed in the female portion. However, the specific type of buckle selected is not critical and any suitable buckle can be used for this purpose. Alternatively any other type of latching structure can be provided for releasably securing together the distal ends of each of the straps. For example, the buckle 131 in FIGS. 1–7 could be replaced by hook and loop type fasteners, adjustable snaps and so on.

According to one embodiment, the straps 126, 128 can include a length adjustable section 134, 136 for permitting the straps to be adjusted from at least a first length to a second length. For example, the length adjustable sections 134, 136 can be formed of an elastic material to allow the length adjustable sections to vary in length by about 150%. The elastic material has the further advantage of automatically adjusting itself in length so that the straps 126, 128 snugly engage a laptop computer 300 disposed within the carrying case. Still, the invention is not limited in this regard and it will be understood by those skilled in the art that other means can be utilized for the purpose of providing the length adjustable sections 134, 136. For example, the length adjustable sections 134, 136 can be formed by means of a looped portion of the strap that can be selectively secured to itself along its length so as to increase or decrease its overall length.

As noted above, the length adjustable strap can be adjustably varied between a first and second length. The purpose of the length adjustable strap sections is to permit the straps 126, 128 to accommodate both small sized laptop computers, such as laptop computer 300, and oversized laptop computers, such as laptop computer 500. In order to accommodate smaller laptop computers, the straps 126, 128 can be relatively short in length so as leave little or no slack when their distal ends are fastened to one another. For example, the first length of each strap 126, 128 can be approximately 50% of the distance between the side panels 106, 108 so that the two lengths together are just long enough to traverse the distance between the two sides 106, 108 of the case. In contrast, the second length of each strap can each have a length that is at least about 55% of the distance between the side panels 106, 108. For example, the second length can be between about 60% to 90% of the distance between the side panels has been found to provide acceptable results. However, the invention is not limited to these ranges and other ranges of adjustable length are acceptable provided that they allow the straps to snugly fit around both small and large size laptops that are to be accommodated within the carrying case as herein described.

Figure 8:
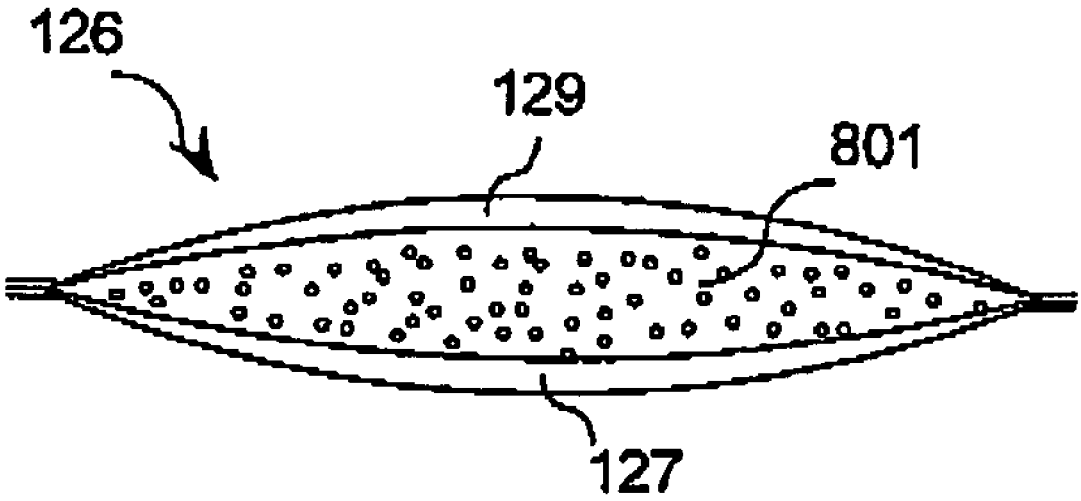
FIG. 8 is a cross-sectional view of the laptop computer carrying case in FIG. 2, taken along line 8—8.

Referring now to FIG. 2 and FIG. 8, a second portion 127, 129 of each strap 126, 128 can advantageously be comprised of a resilient pad material. For example, the resilient pad material 801 can be a formed of foam rubber, neoprene and so on. The resilient pad material 801 can advantageously be provided on a length of the straps sufficient to cover at least the gap 702 between the side panels 106, 108 and the cover flap 112. In this way, the portion of any oversized laptop computer 500 disposed in the carrying case that is left exposed by the gap 702, can be protected against mechanical impact and shocks. The resilient pad material 801 can be disposed within a protective outer fabric layer to protect the pad material from abrasion and to create a more consistent appearance with the exterior of the case. The protective outer fabric layer can be leather, synthetic leather product, nylon web or any other fabric. According to one embodiment, the straps 126, 128 can have a double wall construction, similar to that used for the panels as shown in FIGS. 4 and 6.

The second portion of the strap including the resilient pad material 801 can advantageously be formed to have a width that is at least approximately as wide as the space between the front panel 102 and the real panel 104. In this way any portion of an oversized laptop computer stored in the laptop computer carrying case 100 that is exposed by gap 702 can be protected from mechanical impacts and other adverse environmental conditions.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A laptop computer carrying case of a generally parallelepiped form, comprising:

a front panel, a rear panel spaced apart and opposed from said front panel;

a pair of side panels opposed to each other and attached to said front and rear panels along corresponding side edges of said front and rear panels;

a base panel attached to said front, rear and side panels along a base edge defined respectively on each of said front rear and side panels;

at least one strap having first and second opposing faces attached at a proximal end to each of said side panels, each of said straps having a latching structure disposed at a distal end thereof for releasably securing said distal ends to each other, and a length adjustable section permitting said strap to be adjusted from at least a first length to a second length, wherein at least a portion of one of said first and second faces of each said strap extends substantially adjacent to a face of a respective one of said side panels when a laptop computer is disposed within said carrying case.

2. The laptop computer carrying case according to claim 1, further comprising a cover flap attached to said carrying case that extends across an opening in said carrying case defined by said front, rear and side panels, said cover flap having an overlap with said front panel when secured in a latched position.

3. The laptop computer carrying case according to claim 2, further comprising a latch point positioner, said latch point positioner selectively controlling a slack in said cover flap.

4. The laptop computer carrying case according to claim 3, wherein said slack at least partially encloses an auxiliary carrying case volume exclusive of a main volume defined by said front, rear, base and side panels.

5. The laptop computer carrying case according to claim 1, wherein at least a first portion of said strap is comprised of a resilient pad material.

6. The laptop computer carrying case according to claim 5, wherein said resilient pad material is disposed within a protective outer fabric layer.

7. The laptop computer carrying case according to claim 5 wherein said first portion of said strap has a length extending a predetermined distance beyond an edge of said side wall defining an opening in said case, whereby said strap provides a protective covering for at least a portion of an oversized laptop computer disposed in said carrying case.

8. The laptop computer carrying case according to claim 5 wherein at least a second portion of said strap is formed from an elastic material.

9. The laptop computer carrying case according to claim 1, wherein said first length is approximately 50% of the distance between said side panels.

10. The laptop computer carrying case according to claim 9, wherein said second length is between about 60% and 90% of the distance between said side panels.

11. The laptop computer carrying case according to claim 10 wherein at least a portion of said strap is formed from an elastic material.

12. The laptop computer carrying case according to claim 1 wherein said latching structure is a buckle.

13. The laptop computer carrying case according to claim 1 wherein at least a portion of said strap is formed from an elastic material.

14. A laptop computer carrying case of a generally parallelepiped form, comprising:

a front panel, rear panel spaced apart and opposed from said front panel;

a pair of side panels attached to said front and rear panels along corresponding side edges of said front and rear panels;

a base panel attached to said front, rear and side panels along a base edge defined respectively on each of said front rear and side panels;

at least one strap attached at a proximal end to each of said side panels, each of said straps having a latching structure disposed at a distal end thereof for releasably securing said distal ends to each other, and a length adjustable section permitting said strap to be adjusted from at least a first length to a second length; and wherein a width of said straps is approximately the same as a distance between said front panel and said rear panel.

15. A laptop computer carrying case of a generally parallelepiped form, comprising:

a front panel, a rear panel spaced apart and opposed from said front panel;

a pair of side panels opposed to each other and attached to said front and rear panels along corresponding side edges of said front and rear panels;

a base panel attached to said front, rear and side panels along a base edge defined respectively on each of said front rear and side panels;

a cover flap attached to said carrying case that extends across an opening defined by said front, rear and side panels, said cover flap having an overlap with said front panel when secured in a latched position a latch point positioner, said latch point positioner selectively controlling a slack in said cover flap, said slack at least partially enclosing an auxiliary carrying case volume exclusive of a main volume defined by said front, rear, base and side panels; and at least one strap extending from said side panel and substantially covering a gap area between said side panel and said cover flap.

16. The laptop computer carrying case according to claim 15, wherein at least one of said straps is attached at a proximal end to each of said side panels, each of said straps having a latching structure disposed at a distal end thereof for releasably securing said distal ends to each other.

17. The laptop computer carrying case according to claim 15, wherein said strap includes a length adjustable section permitting said strap to be adjusted from at least a first length to a second length.

18. The laptop computer carrying case according to claim 17, wherein said first length is approximately 50% of the distance between said side panels.

19. The laptop computer carrying case according to claim 18, wherein said second length is between about 60% and 90% of the distance between said side panels.

20. The laptop computer carrying case according to claim 15, wherein at least a first portion of said strap is comprised of a resilient pad material.

21. The laptop computer carrying case according to claim 20 wherein said resilient pad material is disposed within a protective outer fabric layer.

22. The laptop computer carrying case according to claim 20 wherein said first portion of said strap has a length sufficient to extend a predetermined distance beyond an edge of said side wall defining an opening in said case, whereby a protective covering is provided for at least a portion of an oversized laptop computer disposed in said carrying case.

23. The laptop computer carrying case according to claim 15 wherein at least a portion of said strap is comprised of an elastic material and a portion of said strap is comprised of a resilient pad material.

24. The laptop computer carrying case according to claim 23 wherein said resilient pad material covers at least a gap area between said side panel and said cover flap that is created by said slack.

25. A laptop computer carrying case of a generally parallelepiped form, comprising:

a front panel, a rear panel spaced apart and opposed from said front panel;

a pair of side panels attached to said front and rear panels along corresponding side edges of said front and rear panels;

a base panel attached to said front, rear and side panels along a base edge defined respectively on each of said front rear and side panels;

a cover flap attached to said carrying case that extends across an opening defined by said front, rear and side panels, said cover flap having an overlap with said front panel when secured in a latched position a latch point positioner, said latch point positioner selectively controlling a slack in said cover flap, said slack at least partially enclosing an auxiliary carrying case volume exclusive of a main volume defined by said front, rear, base and side panels; and at least one strap extending from said side panel and substantially covering a gap area between said side panel and said cover flap;

wherein said strap has a width at least approximately the same as a distance between said front panel and said rear panel.

26. A laptop computer carrying case of a generally parallelepiped form, comprising:

a front panel, a rear panel spaced apart and opposed from said front panel;

a pair of side panels attached to said front and rear panels along corresponding side edges of said front and rear panels;

a base panel attached to said front rear and side panels along a base edge defined respectively on each of said front rear and side panels;

a cover flap attached to said carrying case that extends across an opening defined by said front, rear and side panels, said cover flap having an overlap with said front panel when secured in a latched position a latch point positioner, said latch point positioner selectively controlling a slack in said cover flap, said slack at least partially enclosing an auxiliary carrying case volume exclusive of a main volume defined by said front, rear, base and side panels;

at least one strap extending from each of said side panels and substantially covering a gap area between said side panel and said cover flap, each of said straps attached at a proximal end to each of said side panels, and having a latching structure disposed at a distal end thereof for releasably securing said distal ends to each other, and wherein said straps include a length adjustable section permitting said strap to be adjusted from at least a first length to a second length.

27. The laptop computer carrying case according to claim 26 wherein at least a portion of said strap is comprised of an elastic material and a portion of said strap is comprised of a resilient pad material.

28. The laptop computer carrying case according to claim 27 wherein said resilient pad material covers at least a gap area between said side panel and said cover flap that is created by said slack.

29. The laptop computer carrying case according to claim 28 wherein said resilient pad material is disposed within a protective outer fabric layer.

30. The laptop computer carrying case according to claim 26 wherein said first length is approximately 50% of the distance between said side panels.

31. The laptop computer carrying case according to claim 30, wherein said second length is between about 60% and 90% of the distance between said side panels.

* * * * *